US005452658A

United States Patent [19]

Shell

[11] Patent Number: 5,452,658

[45] Date of Patent: Sep. 26, 1995

[54] PAD TRANSFER PRINTING PADS FOR USE WITH CONTACT LENSES

[75] Inventor: Richard S. Shell, Rindge, N.H.

[73] Assignee: Diversified Decorating Sales, Inc., Jaffrey, N.H.

[21] Appl. No.: 277,103

[22] Filed: Jul. 20, 1994

[51] Int. Cl.[6] ..... B41C 1/00

[52] U.S. Cl. ..... 101/401.1; 101/41; 428/908

[58] Field of Search ..... 101/35, 41, 401.1, 101/163, 164, 165, 166, 379, 44, 401.2, 368, 493, 488; 428/908, 909

[56] References Cited

U.S. PATENT DOCUMENTS

| | | | |
|---|---|---|---|
| 2,748,696 | 6/1956 | Murray | 101/41 |
| 3,688,695 | 9/1972 | James | 101/488 X |
| 3,701,317 | 10/1972 | Miyamoto et al. | 101/41 X |
| 4,019,436 | 4/1977 | Handweiler et al. | 101/41 X |
| 4,297,945 | 11/1981 | Sano et al. | 101/401.1 X |
| 5,054,390 | 10/1991 | Birtles et al. | 101/41 X |
| 5,252,428 | 10/1993 | Kawamoto et al. | 101/401.1 X |

*Primary Examiner*—Chris A. Bennett
*Attorney, Agent, or Firm*—George W. Dishong

[57] ABSTRACT

A room temperature vulcanized silicone pad which is used in pad transfer printing on contact lenses with a special opaque ink which has been approved by the FDA and which results in a longer life span, better print quality, improved adhesion of the ink, more resistance to swelling from the ink, and is cheaper to manufacture. The silicone pad is manufactured from Dow Corning® HS III base resin, Dow Corning® HS III colored catalyst, Loctite® (Visilox®) V-50 silicone oil, and Loctite® (Visilox®) Vi-cure #2 stannous-tin-octuate in the approximate ratios of 100:10:17.5:0.1 at room temperature and then added to a suitable base for later attachment to a pad transfer printing machine.

28 Claims, 1 Drawing Sheet

PAD TRANSFER PRINTING PADS FOR USE WITH CONTACT LENSES

BACKGROUND OF THE INVENTION

1. Field of the Invention

This invention most generally relates to pad transfer printing pads. Even more particularly to pad transfer printing pads used on contact lenses. Even more specially to pad transfer printing pads used with a special ink or media to render the iris part of contact lens opaque.

2. Description of the Prior Art

Pad transfer printing has been in use for over 100 years. However, new inks and print pads must be developed as new articles of manufacture present new substrates and non-flat surfaces to be imprinted. Printing is no longer done on just paper or just flat surfaces or even hard surfaces. Such is the case with contact lenses. The lenses are delicate and require a printing pad which is soft so as not to damage the lens during the printing cycle. The print pad must also be able to resist any chemical action of the ink, be adequately resilient to "remember" its shape when it picks up more ink for the next impression, and be of such durability to withstand hundreds of print cycles in order to be economically feasible.

The prior art was not that instructional. U.S. Pat. No. 5,142,722 by Kolb, *Transfer Printing of Furniture End Pieces,* teaches heat transfer of sublimation decals at high pressure and high temperature (in the range of 400° F.). This method is not suitable for contact lens printing. U.S. Pat. No. 5,193,457 by Hahn et al., *Process for Printing on a Glass Sheet with a Decorative Frame,* teaches a process of silk-screening onto glass. U.S. Pat. No. 5,270,507 by Nakamura et al., *Push Button Switch and Method for Manufacturing Same,* teaches heat transfer printing to rubber materials at temperatures in the range of 150° C. to 230° C. U.S. Pat. No. 5,280,006 by Beck et al., *Thermal Transfer Printing Receiver,* relates to printing by transferring frown a dyesheet to a receiver in response to a thermal stimuli. As can be readily seen, the prior art has no relevance with the current invention.

Initially, contact lenses were tinted when the wearer wanted to enhance the iris color of his or her eyes. However, until very recently, printing on the contact lens to such an extent as to change the wearer's iris color entirely was not possible. The ink, or media, had to be opaque and be placed on the side of the contact lens that comes into contact with the eyelid. The industry was slow to find such a media with both characteristics of opacity and safety.

An opaque ink was specifically created for contact lenses and covered in U.S. Pat No. 4,668,240 by Loshaek, *Pigment Colored Contact Lenses and Method for Making Same.* The ink can tint a lens or make it opaque depending on the dye used. When the ink is dry on the contact lens, it is inert enough to have been approved by the FDA to be worn next to the eyelid. However, when wet, it caused the print pads' printing quality in use at the time to disintegrate much faster than normal because of swelling.

The print pads used previously for pad transfer printing could not be used with the new ink because it destroyed the pad transfer printing pads too quickly to be economically feasible. New print pads were developed, but these improvements still had problems. In the automated system, the ink stays on the print pad long enough to start a chemical reaction with the pad. The print pads that are currently in use do not last more than three to four hours of continuous printing. This translates to approximately 1,200 impressions before the print pads are no longer usable and must be replaced. The time used to stop the printing machine and replace the pad transfer printing pads is lost time and must be charged to the overall cost of manufacturing printed contact lenses. There is also a problem over time with the print pad swelling as a reaction to the ink. When the print pad swells, the printing precision is compromised.

Another problem with the print pads previously used was the poor adhesion. The old print pads would transfer the ink to the lens, but the ink would not always adhere permanently to the lens.

It would be desirable and advantageous to create a pad transfer printing pad soft enough to be used for contact lenses that would accept the ink from a source and release the ink freely to the lens (more affinity than the ink source but less affinity than the lenses), that would last for more than three hours on an assembly line (or more than 1,200 transfers), and still retain all the positive aspects of the prior art. The savings of such a pad transfer printing pad would be twofold: an initial savings for a reduced number of print pads to make the same number of contact lens impressions, and secondly, the times saved on a work shift that previously was used to change the print pads at least twice during every shift (some shifts now require three changes).

It would be desirable if the improved print pad provided good adhesion of the ink to the contact lens.

It would also be desirable and advantageous if the greatly improved print pads cost no more than, or even less than, the current state of the art pad transfer printing pads. This additional cost cutting measure would result in a threefold savings over the prior art.

It would also be desirable if the print pads had an improved resistance to swelling caused by the ink. This attribute would enhance the print quality.

SUMMARY OF THE INVENTION

The present invention in its most simple form or embodiment is directed to a method of manufacturing a print transfer printing pad and the print pad created by the process. When used, the silicone portion of the print pad is attached to a pad printing machine by means of a print pad base. The base chemically attaches to the silicone portion of the print pad and mechanically attaches to the pad printing machine. In one instance, the base is made of aluminum and is provided by the owner of the pad printing machine to be used. The exact nature of the base depends on the pad transfer printing machine. Generally, the base is anodized aluminum and substantially flat on the side (the obverse side) to be bonded with the silicone portion of the print pad. It is clear to one of ordinary skill in the art that other materials can be used for the base, such as other metals, wood, or plastic.

A room temperature vulcanized silicone print pad is created using a blend of Dow Corning® HS III A base resin and Dow Corning® HS III B colored catalyst. Loctite® (Visilox®) V-50 silicone oil is used to adjust the durometer of the final product. Loctite® (Visilox)® Vi-cure #2 stannous-tin-octuate (STO) catalyst is used as an accelerator to speed curing.

Several chemicals and compounds are used by their trademarked name in this application. The ingredients or trade names are listed as follows. Dow Corning® HS III A is a base resin comprising zirconium silicate. CAS #10101527, trimethylated silica, CAS # 68909206, dimethyl siloxane, hydroxy-terminated. CAS #701316768, polydimethylsiloxane, CAS #63148629, and isopropanol, CAS #67630. Dow Corning® HS III B is a colored catalyst comprising polydimethylsiloxane, CAS #63148629, tetrapropyl orthosilicate, CAS # 682019, phenyltrimethoxysilane, CAS #2996921, and dibutyltin dilaurate, CAS #77587. The base resin and colored catalyst are a two part room temperature vulcanizing silicone rubber made by Dow Corning. Loctite® (Visilox®) V-50 silicone oil is a 50 centistoke nonreactive dimethyl silicone fluid. Loctite® (Visilox®) Vi-Cure #2 is the brand name of a catalyst accelerator stannous 2-ethylhexanonate, CAS #301010, which is 95 to 100 percent pure.

The actual process consists of mixing the Dow Corning® HS III A base resin with 17.5 Loctite® (Visilox®) percent V-50 silicone oil and filtered to remove extraneous matter. (Measurements are given by weight as a percentage of the weight of the first component, i.e., Dow Corning® HS III A base resin.) Next, 10 percent Dow Corning® HS III B colored catalyst and 0.1 percent STO are mixed and filtered. The Dow Corning® HS III A base resin mixture and the Dow Corning® HS III B catalyst mixture are blended and mechanically mixed for three minutes. The resulting mixture is desired by exposure to a partial vacuum until it rises and falls. This step insures void-free pads and print surfaces. The mixture is poured into prepared molds previously prepped and cleaned. These are left to set for 20 to 50 minutes.

The aluminum bases are prepared up to 24 hours in advance by coating with GI-Primer brand of primer manufactured by Silicone, Inc. and air cured for at least 30 minutes in a dust-free vented chamber.

At the end of the 20 to 50 minutes set up time of the silicone portion of the print pad, the obverse side of the anodized aluminum bases are applied to the exposed side of the silicone portion of the print pad.

After 24 hours, the print pads are taken out of the molds and inspected for imperfections on the printing surface.

A primary object of the invention is to produce a pad transfer printing pad which retains all of the prior technology pad's advantages, but still offers improved image release and transfer characteristics.

Another primary object of the invention is to produce a pad transfer printing pad which will generate excellent adhesion of the ink to the contact lens substrate.

A further object of the invention is to produce a pad transfer printing pad which has an improved life span. This would allow more contact lens to be printed from one print pad, thus lowering the cost per contact lens. Another cost benefit of an improved life span would come from stopping the machine print production cycle less often to replace the print pads.

A still further objective of the invention is to produce a print pad with improved resistance to swelling as a reaction to the ink. The accuracy of the printing would be greatly enhanced with such an improvement.

A yet still further primary objective is to provide a product with the attributes above at a cheaper manufacturing cost.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

The following is a description of the preferred embodiment of the invention. It is clear that there may be variations in the size and shape of the print pad and the trade names of the materials used in the preparation. Other equivalent generic silicone resins, catalysts, oils, and accelerators could be used. However, the main features of the print pad are consistent and are: improved image release and transfer characteristics, improved adhesion of the ink to the substrate, improved life span because of improved resistance to swelling as a reaction to the ink and because of better durability to withstand repeated use, and lower production costs of the print pad.

Figure 1:
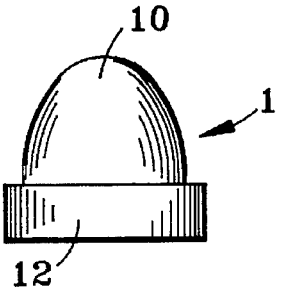
FIG. 1 is a perspective illustration of the improved pad transfer printing pad.
Figure 2:
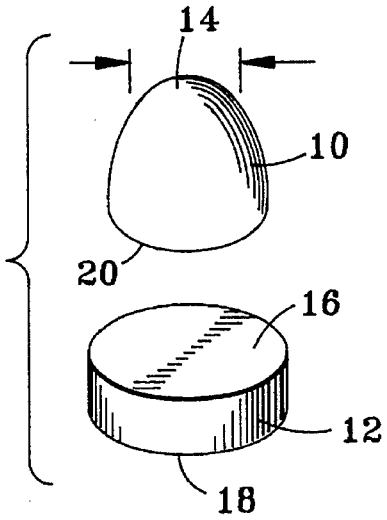
FIG. 2 is an exploded view of the same print pad.
Figure 3:
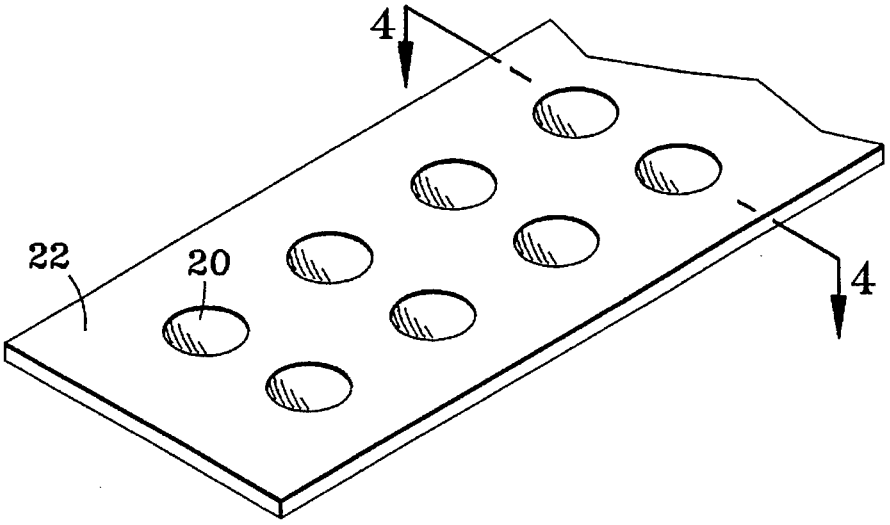
FIG. 3 is a perspective view of the mold.
Figure 4:
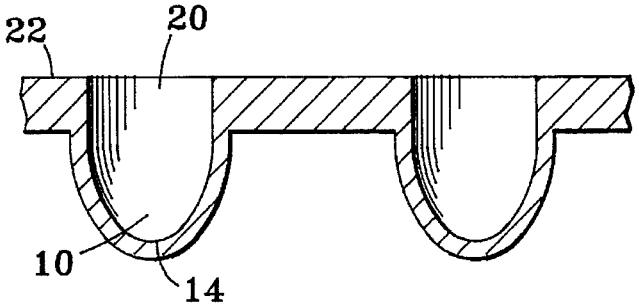
FIG. 4 is a cross section of the mold.

Reference is now made to FIG. 1 which shows the improved pad transfer printing pad 1. The print pad 1 consists of a room temperature vulcanized silicone portion 10 of the print pad 1 and a base 12.

The silicone portion 10 contains the print area 14. The print area 14 is that section of the print pad 1 which actually comes into contact with the contact lens. It touches and receives the ink source and then deposits the ink on the contact lens. The print area 14 is the topmost segment of the print pad 1 and approximately 1 inch±0.05 in diameter. The exact size may vary, of course, depending on the size of the contact lens and the total area of the lens to be inked.

The base 12 is what attaches the silicone portion 10 of the print pad 1 to the pad transfer printing machine. The obverse side 16 is approximately flat to chemically bond with the silicone portion 10 of the print pad 1. The design of the reverse side 18 of the base 12 depends on the pad transfer printing machine that is used. The reverse side 18 must conform to the pad transfer printing machine's method or attachment. The bases 12 can be made from a variety of materials: aluminum or other metals, plastic, or wood. The advantage of aluminum is its strength and that it can be reused. The old silicone pad is scraped off, the surface is cleaned and prepped, and ready for reuse. Plastic bases are inexpensive enough to be used once and then discarded. Wood is cheap enough to be used once and discarded.

The materials for the preferred embodiment are 100 units by weight of Dow Corning® HS III A base resin, approximately 10 units by weight of Dow Corning® HS III B colored catalyst, approximately 17.5 units by weight Loctite® (Visilox®) V-50 silicone oil, and approximately 0.1 unit by weight Loctite® (Visilox®) Vi-cure #2 STO catalyst as an accelerator.

The silicone portion 10 of the print pad 1 is manufactured using the percentage of ingredients as listed above for the preferred embodiment. Dow Corning® HS III A base resin is mixed with Loctite® (Visilox®) V-50 silicone oil to achieve desired durometer (hardness) of 60±5 on OO scale. The mix is strained through doubled very fine but conventional and commercially available paint filters to remove any extraneous matter. The Dow Corning® HS III B colored catalyst and Loctite® (Visilox®) Vi-cure #2 STO catalyst accelerator are mixed together an strained through a single very fine paint filter into the prestrained Dow Corning® HS Ill A mixture. The two mixtures are mechanically mixed for three minutes using any convenient and generally available brand of mixer, such as a Kitchen-Aid® mixer using the wire whisk attachment. The resultant mixture is desired by removal from the mixing container to a clean container and placed in a partial vacuum at a pressure lower than 29 inches of mercury until the material rises and subsequently tails. The desired mixture is poured into the cavities of mold 22 that were previously prepared. One such mold 22 that is used is high impact styrene 0.060 inch vacuum formed over male molds. The material or resultant mixture now in the molds 22 is left to stand and set up for about between 20 to 50 minutes. The molded material (which will become the silicone portion 10 of the print pad 1) is properly set when the liquidity first disappears. Liquidity is tested by touch. If the bases 12 are added before this point, any impurities which are on the base 12 may come lose and fall to the bottom of the mold 22 which is the print area 14 of the print pad 1.

At the end of the set time, the previously cleaned and prepped anodized aluminum bases 12 are set primed side down (obverse side 16) into the molds 22 on the exposed area 20 of the partially set silicone.

The bases 12 are recycled so they need to be cleaned of any residue before reuse. The base 12 is prepared by cleaning with acetone and treating with a primer. In the preferred embodiment, the aluminum bases 12 are prepped with GI-Primer brand of primer manufactured by Silicones, Inc., and air cured for 30 minutes in a vented dust free chamber. The reverse side 18 and sides of base 12 are treated with non-silicone pattern release (such as Pattern Release 202 manufactured by National Engineering Products, Inc. of Washington, D.C.) to facilitate removal of excess material. The obverse side 16 of the base 12 that bonds with the exposed silicone 20 generally is substantially flat.

The print pads 1 are demolded after 24 hours and inspected for impurities that may have settled to the bottom of the mold 22 where the top of the silicone portion 10 of the print pad 1 resides. The print area 14 of the print pad 1 is on the top of the silicone portion 10 and will receive the impurities. Any print pad 1 with an impurity in the print area 14 has to be discarded. Less than three percent have been found to have such impurities.

A shiny surface on the silicone portion 10 of the print pad 1 will not perform as well as a dull finish. The ink transfer is not as good. If a matte finish mold is not used, the surface of the silicone portion 10 of the print pad 1 can be treated with hexane to take away the shine and slightly rough up the surface.

There are several variations from the preferred embodiment. The effective range for the above materials varies. The Dow Corning® HS III B colored catalyst can range from 7 to 15 percent. Outside this range, the mixture remains tacky and never properly sets. The percentage used in the preferred embodiment gives the best results. The color is obviously affected with different amounts of HS III B colored catalyst used.

The Loctite® (Visilox®) V-50 silicone oil can vary from 10 to 30 percent. This controls the durometer of the final product. Too much silicone oil and the final product is too soft as more oil lowers the durometer.

The Loctite® (Visilox®) Vi-cure #2 STO catalyst accelerator can vary from 0.05 to 0.15 percent, but will vary the rate of cure. A lower amount will lengthen the cure time. One with ordinary skill in the art will realize that other accelerators can be used such as Loctite® (Visilox®) Vi-cure #6. If time is not of concern, no accelerator need be used. In this case, the time to demold is lengthened.

The standing time in the mold 22 before adding the base 12 can vary from between about 20 minutes to 50 minutes. Those times may be further modified depending on the humidity. The higher the humidity, the faster the mixture sets, just the opposite of what one would expect.

In benchmark testing, the improved print pad 1 performed approximately four times better than currently used. The prior used pads lasted no more than three to four hours while the improved print pad 1 lasted more than twelve hours. The output measurements are about 1,200 contact lenses printed with the prior used pads and 5,000 contact lenses printed with the new print pads 1. This fact alone will produce significant savings just from the down time required to stop the assembly line to change the pads. On a 24 hour schedule, the new print pad 1 will require one change rather than six to eight with the prior used pad. With the new print pads 1, some shifts call run an entire eight hours without stopping production to change the print pads 1. Table 1 gives the results of the prior used pads verses the preferred embodiment.

TABLE I

Test Results of
Prior Used Pads verses Preferred Embodiment

| | Number of Lenses Printed | Duration (Hours) |
|---|---|---|
| Old Pads | 1,200 | 3–4 |
| Preferred Embodiment | 5,000 | 12+ |

Other room temperature vulcanized silicones were tried. Table 2 shows the results of five different brands of silicone material over a range of four different durometer readings. A durometer of less than 50 were not tested as they were too soft to stand up to the repeated printing demands. A durometer of 70 and higher did not work.

Table 2 is a comparison of different brands of room temperature vulcanized silicone rubber when used in a pad transfer printing pad. The results are reported by print quality, adhesion, and durability. Print quality is a measure of the clarity of the printed image. Adhesion is a measure of how well the ink remains on the substrate, in this case contact lenses, after printing. Duration is measured by the number of hours the print pad 1 lasted on the production line before it needed to be replaced. All testing was done by Wesley-Jessen Corporation of Des Plaines, Ill.

Dow Corning® HS II brand of room temperature vulcanizing high strength moldmaking silicone rubber base and resin performed almost as well as the same company's HS III brand of room temperature vulcanizing high strength moldmaking silicone rubber base and resin. The results were not as good at the lower durometer for print quality and adhesion. At the higher durometer readings, the durability was slightly less than the Dow Corning® HS III formula.

Dow Corning® HS IV brand of room temperature vulcanizing high strength moldmaking silicone rubber base and resin highest durometer was only 50. The result of using this compound were only average. Dow Corning® recommends using this brand of silicone for transfer pad printing.

Loctite® V-1050 brand of condensation cure silicone RTV (room temperature vulcanization) had excellent print quality and adhesion, but only one-third to one-half the durability of the preferred embodiment. Their brand of V-1067 condensation cure silicone RTV gave similar results.

The silicone pads made with Rhodorsil® RTV 573 brand of silicone elastomer performed so poorly in the adhesion phase of the test that the duration tests were not performed.

Dow Corning® offers three different catalysts to blend with the Dow Corning® HS III brand of base resin. The pink colored catalyst was chosen and gives a pink color to the preferred embodiment silicone print pad 1.

This silicone system is a tin-based system. Platinum-based systems were also examined since platinum systems are usually better and last longer. However, none of the platinum systems were compatible with the ink used for printing on contact lens. The big difference in the print pad 1 was noticed when the manufacturing was fully automated. The ink remained on the print pads 1 six times longer than it had previously during the manual method. It is felt the preferred embodiment works far better than the other systems because the silicone portion 10 reacts with the ink to cause a better adhesion to the lens. The chemical reaction of the ink started during that increased time on the print pad 1, and as a result, adhered better to the contact lens.

With all the technical improvements and advantages as over the prior art pads, there is the advantage that the improved print pad 1 arc cheaper to manufacture than the prior art that they replace.

It is thought that many of the attendant advantages will be understood from the foregoing description and it will be apparent that various changes may be made in the form of the silicone pads, the materials used in their composition without departing from the spirit and scope of the invention or sacrificing all of its material advantages, the form hereinbefore described being merely a preferred or exemplary embodiment thereof.

TABLE 2

Test Results of Room Temperature Vulcanization Silicone Print Pads

| | Durometer (00 Scale) | | | | | | | | | | | |
|---|---|---|---|---|---|---|---|---|---|---|---|---|
| | 50 | | | 55 | | | 60 | | | 65 | | |
| BRAND OF RTV | P | A | D | P | A | D | P | A | D | P | A | D |
| Dow Corning ® HS II | A | A | 8 | E | E | 8 | E | E | 9–12 | E | E | 8–9 |
| Dow Corning ® HS III | A | E | 6–8 | E | E | 8 | E | E | 12 | E | E | 12 |
| Dow Corning ® HS IV | A | A | 6–8 | | na | | | na | | | na | |
| Rhodorsil ® 573 | E | P | nt | E | P | nt | E | P | nt | E | P | nt |
| Loctite ® 1050 | A | E | 4 | E | E | 4 | E | E | 4–6 | E | A | 6 |
| Loctite ® 1067 | A | E | 4 | E | E | 4 | E | E | 4–6 | | na | |

P = Print Quality: E = Excellent, A = Average, P = Poor
A = Adhesion: E = Excellent, A = Average, P = Poor
D = Durability, expressed in hours
na = Not available in a durometer greater than 50
nt = no test performed

I claim:

1. A method of manufacturing a pad transfer printing pad suitable for transferring ink to contact lenses comprising the steps of:

mixing approximately 100 units by weight of Dow Corning® HS III A base resin with approximately 10 to 30 units by weight of Loctite® (Visilox®) V-50 silicone oil creating thereby HS III A mixture;

straining said HS III A mixture through at least one paint filter;

mixing approximately 7 to 15 units by weight of Dow Corning® HS III B colored catalyst with approximately 0.05 to 0.15 units of Loctite® (Visilox®) Vi-cure #2 stannous-tin-octuate (STO) creating thereby HS III B mixture:

straining said HS III B mixture through at least one paint filter;

combining said HS III A and said HS III B mixtures and mechanically mixing them between about two and five minutes;

desiring said mixed combination by pouring said mixed combination into a container and placing said container having said mixed combination therein into a partial vacuum, said partial vacuum having a pressure of between 26 to 29.5 inches of mercury until said mixed combination rises and falls;

pouring said desired mixed combination into suitably shaped molds;

letting said mixed combination set for between about 20 to 50 minutes until said molded mixed combination loses its liquidity; and placing a base into said suitably shaped mold on top of said mixed combination.

2. A pad transfer printing pad made by the method of claim 1.

3. The method of claim 1 wherein said units of Loctite® (Visilox®) V-50 silicone oil is approximately 17.5 units by weight.

4. A pad transfer printing pad made by the method of claim 3.

5. The method of claim 3 wherein said units of Dow Corning® HS III B colored catalyst is approximately 10 units by weight.

6. A pad transfer printing pad made by the method of claim 5.

7. The method of claim 3 wherein said units of Loctite® (Visilox®) Vi-cure #2 stannous-tin-octuate is approximately 0.1 units of weight.

8. A pad transfer printing pad made by the method of claim 7.

9. The method of claim 1 wherein said units of Dow Corning® HS III B colored catalyst is approximately 10 units by weight.

10. A pad transfer printing pad made by the method of claim 9.

11. The method of claim 9 wherein said units of Loctite® (Visilox®) Vi-cure #2 stannous-tin-octuate is approximately 0.1 units of weight.

12. A pad transfer printing pad made by the method of claim 11.

13. The method of claim 1 wherein said units of Loctite® (Visilox®) Vi-cure #2 stannous-tin-octuate is approximately 0.1 units of weight.

14. A pad transfer printing pad made by the method of claim 13.

15. The method of claim 1 wherein said units of Loctite® (Visilox®) V-50 silicone oil is approximately 17.5 units by weight, said units of Dow Corning® HS III B colored catalyst is approximately 10 units by weight, and said units of Loctite® (Visilox®) Vi-cure #2 stannous-tin-octuate is approximately 0.1 units of weight.

16. A pad transfer printing pad made by the method of claim 15.

17. A pad transfer printing pad suitable for transferring ink to contact lenses comprising:

a base component having a pad receiving surface;

a pad component adhesively attached to said pad receiving surface of said base component;

a printing surface of said pad component having a predetermined and prefaced surface geometry;

said pad component comprising in combination;

an HS III A mixture, said HS III A mixture comprising approximately 100 units by weight of Dow Corning® HS III A base resin mixed with approximately 10 to 30 units by weight of Loctite® (Visilox®) V-50 silicone oil and strained through at least one paint filter, an HS III B mixture, said HS III B mixture comprising approximately 7 to 15 units by weight of Dow Corning® HS III B colored catalyst with approximately 0.05 to 0.15 units of Loctite® (Visilox®) Vi-cure #2 stannous-tin-octuate (STO) and straining said HS III B mixture through at least one paint filter, said HS III A and said HS III B mixtures are combined and mechanically mixed between about two and five minutes, said mechanically mixed combination desired by pouring said mechanically mixed combination into a container and placing said container having said mechanically mixed combination therein into a partial vacuum, said partial vacuum having a pressure of between 26 to 29.5 inches of mercury until said mixed combination rises and falls, said desired mechanically mixed combination poured into suitably shaped molds, said molded combination set for between about 20 to 50 minutes until said molded combination loses its liquidity, and said base component placed into said suitably shaped mold on top of said molded component.

18. The pad transfer printing pad of claim 17 wherein said units of Loctite® (Visilox®) V-50 silicone oil is approximately 17.5 units by weight.

19. The pad transfer printing pad of claim 18 wherein said units of Dow Corning® HS III B colored catalyst is approximately 10 units by weight.

20. The pad transfer printing pad of claim 18 wherein said units of Loctite® (Visilox®) Vi-cure #2 stannous-tin-octuate is approximately 0.1 units of weight.

21. The pad transfer printing pad of claim 17 wherein said units of Dow Corning® HS III B colored catalyst is approximately 10 units by weight.

22. The pad transfer printing pad of claim 21 wherein said units of Loctite® (Visilox®) Vi-cure #2 stannous-tin-octuate is approximately 0.1 units of weight.

23. The pad transfer printing pad of claim 17 wherein said units of Loctite® (Visilox®) Vi-cure #2 stannous-tin-octuate is approximately 0.1 units of weight.

24. The pad transfer printing pad of claim 17 wherein said units of Loctite® (Visilox®) V-50 silicone oil is approximately 17.5 units by weight, said units of Dow Corning® HS III B colored catalyst is approximately 10 units by weight, and said units of Loctite® (Visilox®) Vi-cure #2 stannous-tin-octuate is approximately 0.1 units of weight.

25. A pad transfer printing pad suitable for transferring ink to contact lenses comprising:

a base component having a pad receiving surface;

a pad component adhesively attached to said pad receiving surface of said base component;

a printing surface of said pad component having a predetermined and prefaced surface geometry;

said pad component comprising in combination;

an HS III A mixture, said HS III A mixture comprising approximately 100 units by weight of Dow Corning® HS III A base resin mixed with approximately 10 to 30 units by weight of Loctite® (Visilox®) V-50 silicone oil and strained through at least one paint filter, an HS III B mixture, said HS III B mixture comprising approximately 7 to 15 units by weight of Dow Corning® HS III B colored catalyst strained through at least one paint filter, said HS III A and said HS III B mixtures are combined and mechanically mixed between about two and five minutes, said mechanically mixed combination desired by pouring said mechanically mixed combination into a container and placing said container having said mechanically mixed combination therein into a partial vacuum, said partial vacuum having a pressure of between 26 to 29.5 inches of mercury until said mixed combination rises and falls, said desired mechanically mixed combination poured into suitably shaped molds, said molded combination set for between about 20 to 50 minutes until said molded combination loses its liquidity, and said base component placed into said suitably shaped mold on top of said molded component.

26. The pad transfer printing pad of claim 25 wherein said units of Loctite® (Visilox®) V-50 silicone oil is approximately 17.5 units by weight.

27. The pad transfer printing pad of claim 25 wherein said units of Dow Corning® HS III B colored catalyst is approximately 10 units by weight.

28. The pad transfer printing pad of claim 25 wherein said units of Loctite® (Visilox®) V-50 silicone oil is approximately 17.5 units by weight and said units of Dow Corning® HS III B colored catalyst is approximately 10 units by weight.

* * * * *